United States Patent [19]

Jansen et al.

[11] Patent Number: 4,909,358

[45] Date of Patent: Mar. 20, 1990

[54] HOISTING STATION FOR A RAIL-TRACK PIECE

[75] Inventors: Heinz-Uwe Jansen, D-Herdecke; Johannes-Gerhard Spöler, Borken, both of Fed. Rep. of Germany

[73] Assignee: Mannesmann Aktiengesellschaft, Düsseldorf, Fed. Rep. of Germany

[21] Appl. No.: 111,363

[22] Filed: Oct. 22, 1987

[30] Foreign Application Priority Data

Dec. 18, 1986 [DE] Fed. Rep. of Germany ..... 3643662

[51] Int. Cl.[4] ..... B66B 11/04

[52] U.S. Cl. ..... 187/20; 187/28; 187/94

[58] Field of Search ..... 187/2, 46, 15, 73, 94, 187/1 R, 1 A, 9 R, 20, 22, 23, 28; 182/141

[56] References Cited

U.S. PATENT DOCUMENTS

| | | | |
|---|---|---|---|
| 383,715 | 5/1888 | Ellington | 187/1 A |
| 524,344 | 8/1894 | McLauthlin et al. | 187/1 A |
| 735,093 | 1/1903 | Greenwald | 187/94 |
| 1,700,587 | 1/1929 | Higbee | 187/1 A |
| 1,814,610 | 7/1931 | Steuelman | 187/94 X |
| 1,830,988 | 11/1931 | Evans | 187/1 A |
| 3,592,294 | 7/1971 | Allen | 187/94 X |
| 3,724,688 | 4/1973 | Atwater | 187/22 X |
| 4,526,251 | 7/1985 | Johannson | 187/9 R |
| 4,664,230 | 5/1987 | Olsen | 187/94 X |
| 4,706,782 | 11/1987 | Spoeler et al. | 187/28 X |

FOREIGN PATENT DOCUMENTS

| | | | |
|---|---|---|---|
| 39939 | 6/1965 | German Democratic Rep. | 187/20 |
| 464317 | 8/1951 | Italy | 187/1 R |
| 0136247 | 11/1978 | Japan | 187/1 R |
| 0071273 | 4/1983 | Japan | 187/9 R |
| 502823 | 9/1976 | U.S.S.R. | 187/1 A |
| 541764 | 3/1977 | U.S.S.R. | 187/1 A |
| 1248925 | 3/1986 | U.S.S.R. | 187/20 |
| 777297 | 6/1957 | United Kingdom | 187/1 A |

*Primary Examiner*—Joseph J. Rolla
*Attorney, Agent, or Firm*—Horst M. Kasper

[57] ABSTRACT

A hoisting carriage (2) for a rail-track section (A) of a suspension rail installation can be lifted and lowered at two parallel hoisting columns (1). A motor (4), attached at a cross traverse (3), serves as a drive. The motor (4) drivers via its transmission shaft with two drive wheels (6), disposed on the shaft, for the pulling members (7), which are provided as roller chains. The roller chains are guided initially around upper and lower deflection pulleys (8), disposed freely rotatable on carrying axles, to a rocker. The rocker is supported with a hinged support or trunnion bearing at an oscillating crank (13). The rocker balances or adjusts different elongations and extensions of the pulling members (7). The oscillating crank (13) is supported with a pin bolt (14) at a carrier (15) of the hoisting carriage (2) and rests with the free end at an inclined position on a bumper 16 of the other carrier (15*a*).

20 Claims, 4 Drawing Sheets

Fig. 5
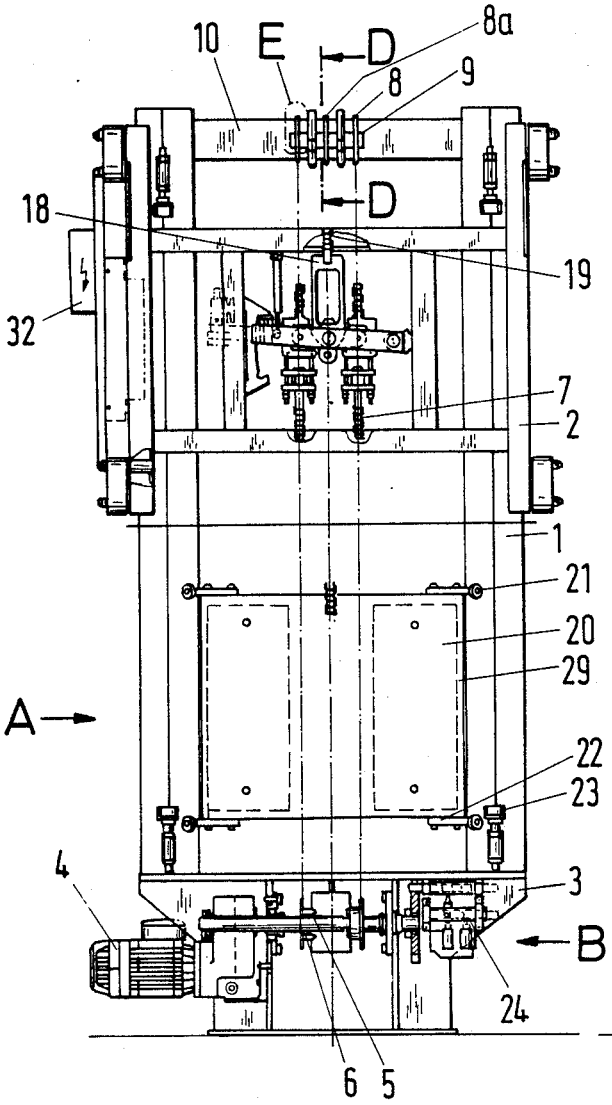
Fig. 6
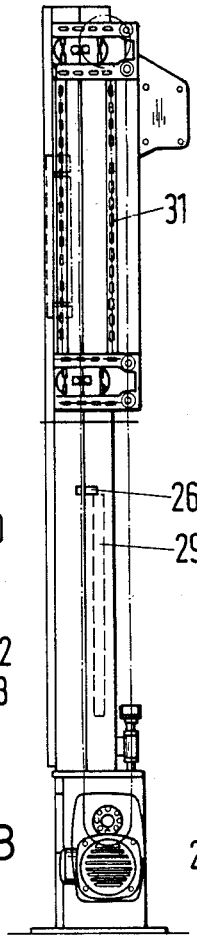
Fig. 9
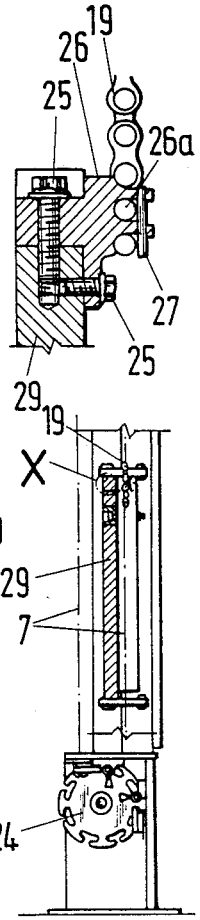
Fig. 7
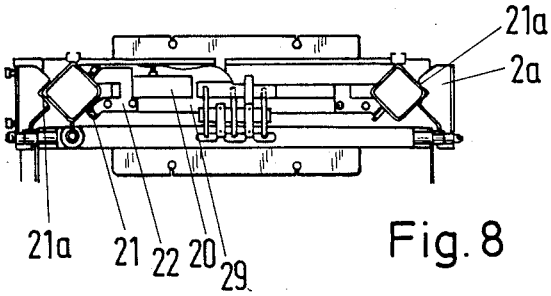
Fig. 8

HOISTING STATION FOR A RAIL-TRACK PIECE

BACKGROUND OF THE INVENTION

1. Field of the Invention

The invention relates to a hoisting station for a rail-track piece of a rail installation, where the rail-track piece is guided with a hoisting carriage at hoisting columns and is supported and driven with a motor via two parallel pulling members, which are guided around the upper and lower deflection pulleys and which are connected as endless pulling members with the hoisting carriage via a rocker.

2. Brief Description of the Background of the Invention Including Prior Art

Such a hoisting station is taught in the German patent application Laid Open DE-OS 36 06 070. There, the rocker causes, in case of an inclined position based on impermissible chain extension or a chain breakage, the switching off of the motor. The motor has to be dimensioned and equipped to handle a full use load for lifting and lowering of the hoisting carriage. Thereby, on the one hand, a large lifting power is required and, on the other hand, the brake is very much used and worn during lowering of the load. In case of an unexpected but not completely excludable damage situation, a drop brake has to be available in order to prevent a precipitous falling.

SUMMARY OF THE INVENTION

1. Purposes of the Invention

It is an object of the invention to provide a hoisting station which is safer and securer than previous hoisting stations.

It is another object of the invention to provide a hoisting station where, while the motor power is decreased, the requirement for braking power is also decreased.

It is a further object of the present invention to provide a hoisting station which minimizes the initial force required to move a rail-track section.

These and other objects and advantages of the present invention will become evident from the description which follows.

2. Brief Description of the Invention

A hoisting station for a rail-track section of a rail installation according to the invention comprises a hoisting column and a hoisting carriage running along the hoisting column. An upper deflection pulley and a lower deflection pulley are fixed in position relative to the hoisting column. Two parallel endless pulling members are supported by and guided around the upper and lower deflection pulleys. A connection member is attached to the endless pulling members. A rocker is attached to the connection member. The hoisting station also comprises a weight-balancing deflection pulley. A weight-balancing pulling member is supported by and guided around the weight-balancing deflection pulley. A balancing weight is supported by the weight-balancing pulling member and connected to the connection member for balancing the weight of the carriage. A motor is fixed in position relative to the hoisting column and is driving the deflection pulleys. A rail-track section is attached to the hoisting carriage and is guided along the hoisting columns by the hoisting carriage such that the rail-track section is maintained in position and driven by said motor via said two parallel pulling members. The two pulling members are guided around upper and lower deflection pulleys and are connected as endless pulling members via the rocker with the hoisting carriage.

The endless pulling members and the weight-balancing pulling member are preferably roller chains.

The balancing weight is preferably adjustable in size.

The hoisting station can comprise a second hoisting column. The rollers can be attached to the balancing weight for guiding the balancing weight by rollers along the two hoisting columns.

The weight-balancing pulling member is preferably disposed between the endless pulling members for the lifting and lowering of the hoisting carriage.

The hoisting station can also comprise an oscillating crank supporting the rocker. A first support carrier can be furnished at the hoisting carriage. A pin bolt can be disposed at the support carrier of the hoisting carriage. A second support carrier is preferably furnished at the hoisting carriage and disposed about parallel to the first support carrier. Preferably, a bumper is attached to the second support carrier for engaging a movable end of the oscillating crank. An operating switch can be disposed at the second support carrier for providing a rest position at the operating switch for an extension of the oscillating crank disposed at the support carrier.

A surveillance switch can be attached to the hoisting carriage. Preferably, a switching pilot is disposed at the rocker for the surveillance switch attached to the hoisting carriage.

The connection member can be formed as a frame which can be provided with an opening for accessing the surveillance switch.

Preferably, a shaft is connected to and driven by the motor and disposed below the hoisting columns. The lower pulleys can serve as drive wheels for the endless pulling members and the shaft can be employed for driving the drive wheels of the endless pulling members.

The hoisting station can comprise drive pulleys for the endless pulling members. Preferably, a shaft is connected to and driven by the motor and disposed at a distance from the hoisting carriage on the side disposed opposite to the hoisting columns and supporting the drive pulleys. The shaft can be employed for driving the drive pulleys such that the pulling members are guided by the drive pulleys around deflection pulleys. The power action lines of the drive pulleys can be disposed between the upper and the lower deflection pulleys.

In accordance with the invention, there is attached to a rocker or a rocking bar a connection piece of a counterweight or balancing-weight pulling member. The balancing-weight pulling member is connected with a balancing weight via an upper deflection pulley. The deflection pulley could be a draw-back wheel. If the hoisting carriage or lift carriage always carries a load during lifting and lowering, then the balancing weight is dimensioned such that it corresponds to the weight of the hoisting carriage plus the maximum load, and preferably from the weight of the hoisting carriage plus 0.8 times an average load to the weight of the hoisting carriage plus 1.5 times an average load. If the hoisting carriage is moved in part without load, then the balancing weight corresponds substantially to the weight of the hoisting carriage and about half the load. The balancing weight reduces therefore the required drive power of the motor and the brake of the hoist is used and worn to a lesser extent. The disposal of the balancing-weight pulling member via the connection member at the rocker assures that the installation is switched off in case of excessively inclined position of the rocker.

The pulling members are preferably roller chains. The changeable counter balance is guided with rollers at the two hoisting columns or lifting columns, between which the counter-balancing weight pulling member is disposed between the pulling members for the lifting and lowering of the hoisting carriage.

The already recited rocker is supported via an oscillating crank with a pin or a bolt at a carrier of the hoisting carriage. The carrier of the hoisting carriage is provided at a further carrier, which further carrier is provided with stops for the movable end of the oscillating crank and thus turns therewith an operating switch. The connection member, resting at the rocker, can be formed as a frame, which is provided with an opening for the access of a surveillance switch to be actuated by the rocker. This surveillance switch shuts off the drive, in case of an impermissible inclined position of the rocker, be it caused by an extending of the chains or by a rupture of the chains, in case of failure of the operating switch, or in case of an inclined position of the connection member.

Since the balancing weight can freely move and since of motion of the balancing-weight pulling member is not interfered with, the motor can be disposed, together with the shaft for the drive wheels of the pulling member driven by the motor, under or at a distance on the side of the hoising column opposite to that of the hoisting carriage such that the drive between upper and lower deflection pulley can be freely positioned.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 5 is a front elevational view of a further embodiment of a hoisting station;

FIG. 6 is a side view of the hoisting station of FIG. 5, from the direction A;

FIG. 7 is a view of the lower part of the hoisting station according to FIG. 5, from the direction B;

FIG. 8 is a plan view of the hoisting station of FIG. 7;

~~FIG. 9 is a view of a detail at an~~ enlarged scale of the hoisting station of FIG. 7;

DESCRIPTION OF INVENTION AND PREFERRED EMBODIMENTS

Figure 1:
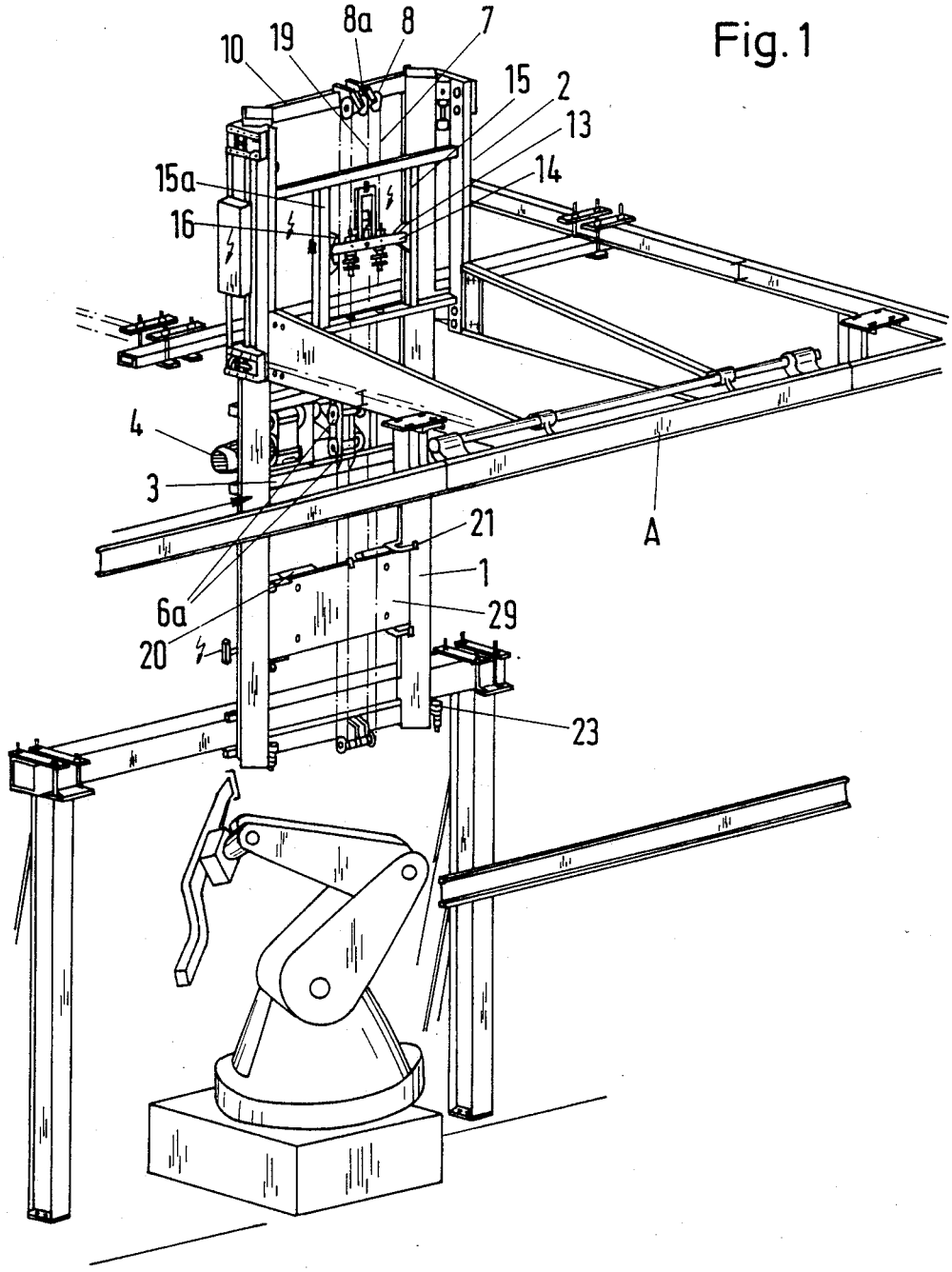
FIG. 1 is a perspective view of a hoisting station.

In accordance with the present invention, there is provided a hoisting station or a lifting and lowering station for a rail-track section of a rail installation. The rail-track section is guided along lifting or hoisting columns 1 by a lifting or hoisting carriage 2 and the rail-track section is maintained in position and driven by a motor via two parallel pulling members. The two pulling members are guided around upper and lower deflection wheels or pulleys 8 and are connected as endless pulling members via a rocker 11 with the hoisting carriage 2. A connection member 18 of the balancing-weight pulling member 19 is attached at the rocker 11. The connection member 18 is connected via an upper deflection pulley **8*a* with a balancing weight 20. Preferably, the pulling members 7, 19 are roller chains. The balancing weight 20 can be of adjustable size. The balancing weight 20 is preferably guided by rollers 21 at the two hoisting columns 1. The balancing-weight pulling member 19 is preferably disposed between the pulling members 7 for the lifting and lowering of the hoisting carriage 2**, which can be a lifting wagon.

The rocker 11 is supported via an oscillating crank 13 with a pin bolt 14 at a support carrier 15 of the hoisting carriage 2. A further support carrier **15*a* is provided running about parallel to the support carrier 15. The support carrier 15*a* is furnished with detent stops or bumpers 16 for the movable end of the oscillating crank 13. An extension of the oscillating crank 13 rests at an operating switch 17 disposed at the support carrier 15*a*. The rocker 11 is preferably provided with a switching pilot 11*a* for a surveillance switch 28 attached to the hoisting carriage 2. The connection member 18 can be formed as a frame which is provided with an opening for accessing the surveillance switch 28. The motor 4, and the shaft 5 driven by the motor and employed for driving the drive wheels 6 of the pulling member 7, is disposed below the hoisting columns 1**.

The motor 4, and the shaft 5 driven by the motor for driving the drive wheels 6, is preferably disposed at a distance from the hoisting carriage 2 on the side disposed opposite to the hoisting columns 1. The pulling members 7 are preferably guided by the drive wheels 6 around deflection pulleys **6*a*. The power action lines or effective curve of the deflection wheels 6*a* are preferably disposed between the upper and the lower deflection wheels or pulleys 8**.

Figure 2:
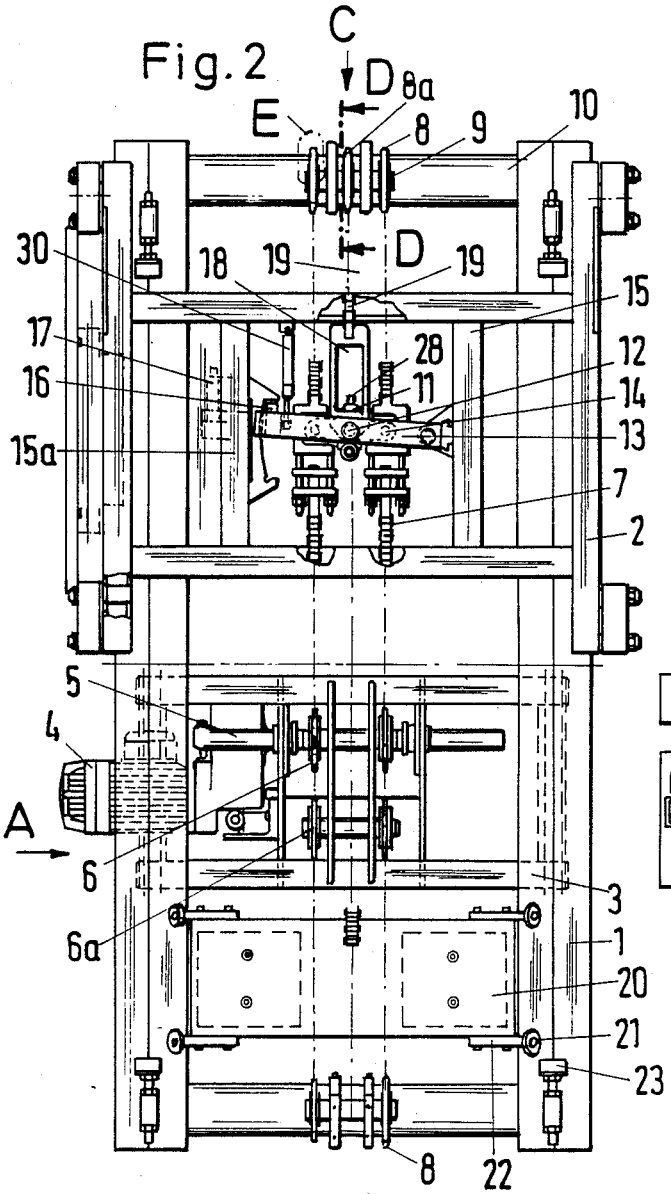
FIG. 2 is a front view of the hoisting station according to FIG. 1.
Figure 10:
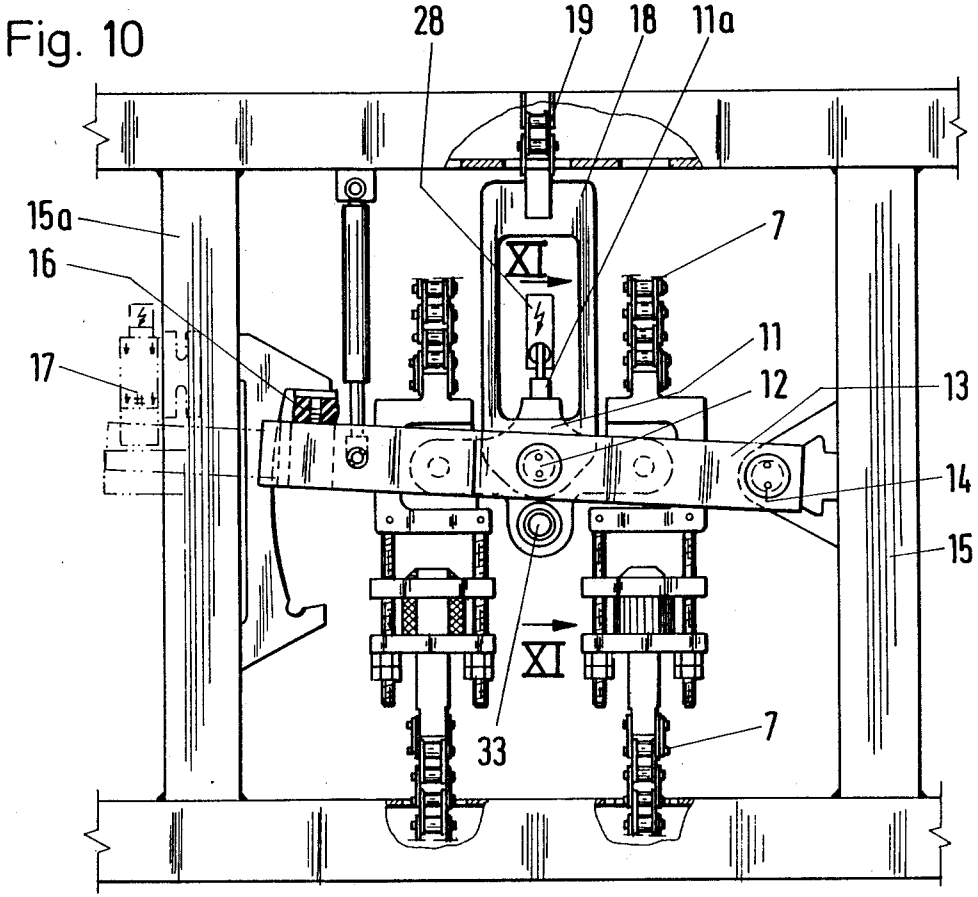
FIG. 10 is an enlarged front elevational view of the disposition of the connecting member.

Referring now to FIG. 1, there is shown a hoisting carriage 2 disposed at two parallel hoisting columns 1 for a rail-track piece A of an overhead trolley conveyor equipment with a rail to support a carriage for, preferably, a suspension railway. The rail-track piece A can be lifted and lowered. A motor 4, attached to the cross traverse 3, serves as a drive. As can be recognized in FIGS. 2 to 4, the motor 4 drives via a transmission a shaft 5 with two drive wheels 6, disposed on the shaft 5, for operating pulling members 7 provided as roller chains. These roller chains initially are guided around deflection pulleys **6*a*, supported at the cross traverse 3, as well as around upper and lower deflection pulleys 6*a*, 8, freely rotatably supported at carrying axes 9, to a rocker 11. The rocker 11 is supported with a hinged support or trunnion bearing 12 at an oscillating crank 13. The rocker 11 balances different elongations of the pulling members 7. The oscillating crank 13 is supported with a pin bolt 14** at a carrier or bearer support 15 of the hoisting carriage 2 and rests with the free end in an inclined disposition at a bumper or detent stop 16 of the other carrier 15*a*. A guiding support, confining the motion of the rocker, is provided at the support carrier 15*a* for limiting the degrees of freedom of motion of the oscillating crank 13. An operating switch 17, attached to the carrier 15*a*, effects a switching off of the motor 4 if the said inclined disposition is no longer present, that is, if the hoisting carriage 2 is no longer supported by the oscillating crank 13. This can occur if the hoisting carriage 2 is supported at the lower bumpers or detent stops 23 or if the rail-track section A rests on its supports. A spring 30 then presses the oscillating crank 13 downwardly, as is indicated in FIG. 10.

Figure 4:
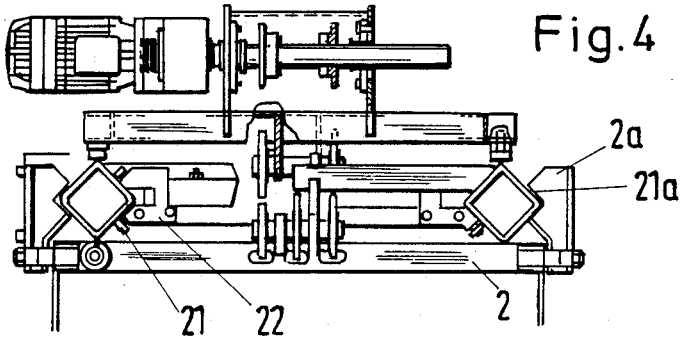
FIG. 4 is a top-plan view on the hoisting station of FIG. 2.

A connection member 18 for a balancing-weight pulling member 19 is supported at the hinged support or trunnion bearing 12, by way of which the rocker 11 is supported in the oscillating crank 13. This balancing-weight pulling member 19 guides around a deflection pulley 8*a* disposed freely rotatable at the carrying axle 9 to a counter-weight frame 29. The counter-weight frame 29 supports the balancing weight 20, consisting of two parts, the the counter-weight frame 29 is guided via roller blocks 22 and rollers 21 at the two hoisting columns 1. Preferably, two rollers 21 are provided for each side of the two hoisting columns 1. As is shown in FIGS. 4 and 8, the hoisting carriage 2 is guided at the hoisting columns 1 via roller blocks 22*a* with rollers 21*a*.

Figure 3:
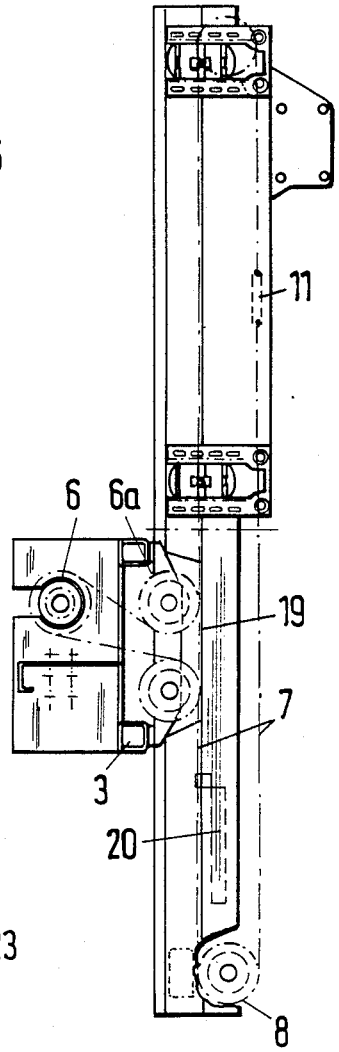
FIG. 3 is a side view of the hoisting station of FIG. 2.

In addition to the guiding of the pulling members 7 around the drive wheel 6 and deflection pulleys 6*a*, and 8 to the rocker 11, FIG. 3 also illustrates the connection of the balancing-weight pulling member 19 to the connection member 18 at the rocker 11, as well as the attachment of the balancing-weight pulling member 19 at the counter-weight frame 29. The counter-weight 29 can freely move by at the deflection pulleys 6*a*.

The attachment of the balancing-weight pulling member 19 at the counter-weight frame 29 is illustrated in FIG. 9 as an enlargement of the detail X from FIG. 7. A positioning stop 26 is attached by way of screws 25 at the counter-weight frame 29. The balancing-weight pulling member 19 is attached with several members of the roller chain and secured by a dowel pin or tie rod 27 at the recesses 26*a* of the positioning stop 26.

In contrast to the embodiment according to FIGS. 1 to 4, the motor 4 with the shaft 5 and the drive wheels 6 is disposed below a cross traverse 3, where the hoisting columns 1 are attached to the cross traverse 3, according to FIGS. 5 to 8. In addition, a fixing device 24, which can be a locking device, a catch, or a detent, is disposed below the traverse 3. The shaft 5 with the drive wheels 6 and the pulling member 7 can be fixed in position with the aid of the fixing device 24. FIG. 6 illustrates punched strips or perforated ledges 31 for a switching box 32 indicated in FIG. 5.

Figure 11:
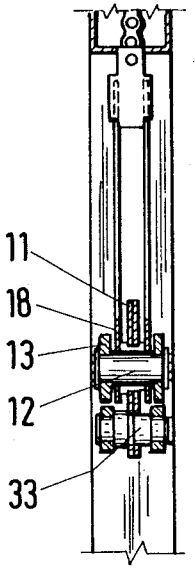
FIG. 11 is a sectional view of the section XI—XI of FIG. 10.

Preferably, the oscillating crank 13 is disposed between two outer bars forming the rocker 11 as shown in FIG. 11. The two outer bars can be held together by bearing blocks or trunnion bearings 12.

A safety bolt 33 is supported in the rocker 11 below the oscillating crank 13, as illustrated in FIGS. 10 and 11. The safety bolt 33 rests, in case of an inclined position of the rocker 11, from below at the oscillating crank 13. The safety bolt 33 is attached in the middle of the bolt to the rocker and the length of the bolt slightly exceeds the distance between the bars forming the oscillating crank 13. In case of an inclined position of the rocker 11, the switching pilot 11*a* of the rocker 11 passes out of the region of the surveillance switch 28, which surveillance switch 28 is attached to the hoisting carriage 2, and the installation is then switched off. The motion of the oscillating crank 13 can be dampened by a shock absorber illustrated in FIG. 10.

It will be understood that each of the elements described above, or two or more together, may also find a useful application in other types of hoisting systems differing from the types described above.

While the invention has been illustrated and described as embodied in the context of a hoisting station for a rail-track piece, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hoisting station for a rail-track section of a rail installation comprising a hoisting column;
   - a hoisting carriage running along the hoisting column;
   - two upper deflection pulleys fixed in position relative to the hoisting column;
   - two lower deflection pulleys fixed in position relative to the hoisting column;
   - two parallel endless pulling members supported by and guided around the upper and lower deflection pulleys;
   - a connection member attached to the endless pulling members;
   - a rocker attached to the connection member;
   - a weight-balancing deflection pulley;
   - a weight-balancing pulling member supported by and guided around the weight-balancing deflection pulley;
   - a balancing weight supported by the weight-balancing pulling member and connected to the connection member for balancing a weight associated with the carriage;
   - a motor fixed in position relative to the hoisting column and driving the deflection pulleys;
   - a rail-track section attached to the hoisting carriage and guided along the hoisting columns by the hoisting carriage such that the rail-track section is maintained in position and driven by said motor via said two parallel pulling members, where the two pulling members are guided around upper and lower deflection pulleys and are connected as endless pulling members via the rocker with the hoisting carriage;
   - a surveillance switch attached to the hoisting carriage; and
   - a switching pilot disposed at the rocker for the surveillance switch attached to the hoisting carriage such that where the switching pilot passes out of the region of the surveillance switch the hoisting station is switched off.

2. The hoisting station for a rail-track section of a rail installation according to claim 1 wherein the endless pulling members and the weight-balancing pulling member are roller chains.

3. The hoisting station for a rail-track section of a rail installation according to claim 1 wherein the balancing weight is adjustable in size.

4. The hoisting station for a rail-track section of a rail installation according to claim 1 further comprising a second hoisting column;

rollers attached to the balancing weight for guiding the balancing weight by rollers along the two hoisting columns.

5. The hoisting station for a rail-track section of a rail installation according to claim 1 wherein the weight-balancing pulling member is disposed between the endless pulling members for the lifting and lowering of the hoisting carriage.

6. The hoisting station for a rail-track section of a rail installation according to claim 1 further comprising an oscillating crank supporting the rocker;

a first support carrier furnished at the hoisting carriage;

a pin bolt disposed at the support carrier of the hoisting carriage and supporting the oscillating crank;

a second support carrier furnished at the hoisting carriage and disposed about parallel to the first support carrier; and a bumper attached to the second support carrier engaging a movable end of the oscillating crank; and an operating switch disposed at the second support carrier for providing a rest position at the operating switch for an extension of the oscillating crank disposed at the support carrier.

7. The hoisting station for a rail-track section of a rail installation according to claim 1 wherein the connection member is formed as a frame which is provided with an opening for accessing the surveillance switch.

8. The hoisting station for a rail-track section of a rail installation according to claim 1 further comprising a shaft connected to and driven by the motor and disposed below the hoisting columns, wherein the lower pulleys serve as drive wheels for the endless pulling members and wherein the shaft is employed for driving the drive wheels of the endless pulling members.

9. The hoisting station for a rail-track section of a rail installation according to claim 1 further comprising drive pulleys for the endless pulling members;

a shaft connected to and driven by the motor and disposed at a distance from the hoisting carriage on the side disposed opposite to the hoisting columns and supporting the drive pulleys, wherein the shaft is employed for driving the drive pulleys such that the pulling members are guided by the drive pulleys around deflection pulleys; and wherein the power action lines of the drive pulleys are disposed between the upper and the lower deflection pulleys.

10. The hoisting station for a rail-track section of a rail installation according to claim 1 further comprising a second hoisting column;

rollers attached to the balancing weight for guiding the balancing weight by rollers along the two hoisting columns;

an oscillating crank supporting the rocker and wherein the balancing weight is adjustable in size;

a first support carrier furnished at the hoisting carriage;

a pin bolt disposed at the support carrier of the hoisting carriage and supporting the oscillating crank;

a second support carrier furnished at the hoisting carriage and disposed about parallel to the first support carrier;

a bumper attached to the second support carrier for engaging a movable end of the oscillating crank;

an operating crank switch disposed at the second support carrier for providing a rest position at the operating switch for an extension of the oscillating crank disposed at the support carrier;

a shaft connected to and driven by the motor and disposed below the hoisting columns, wherein the lower pulleys serve as drive wheels for the endless pulling members and wherein the shaft is employed for driving the drive wheels of the endless pulling members;

drive pulleys for the endless pulling members wherein the endless pulling members and the weight-balancing pulling member are roller chains, wherein the power action lines of the drive pulleys are disposed between the upper and the lower deflection pulleys and wherein the weight-balancing pulling member is disposed between the endless pulling members for the lifting and lowering of the hoisting carriage;

a shaft connected to and driven by the motor and disposed at a distance from the hoisting carriage on the side disposed opposite to the hoisting columns and supporting the drive pulleys, wherein the shaft is employed for driving the drive pulleys such that the pulling members are guided by the drive pulleys around deflection pulleys;

wherein the connection member is formed as a frame which is provided with an opening for accessing the surveillance switch.

11. A hoisting station for a rail-track section of a rail installation where the rail-track section is guided along two hoisting columns (1) by a lifting or hoisting carriage (2) and a rail-track section is maintained in position and driven by a motor via two parallel pulling members, where the two pulling members are guided around upper and lower deflection pulleys (8, 6) and are connected as endless pulling members via a rocker (11) with the hoisting carriage (2), wherein a connection member (18) of a balancing-weight pulling member (19) is attached at the rocker (11), where the connection member (18) is connected via an upper deflection pulley 8*a* with a balancing weight (20) and wherein the rocker (11) is supported via an oscillating crank (13) with a pin bolt (14) at a support carrier (15) of the hoisting carriage (2);

wherein a further support carrier 15*a* is provided running about parallel to the support carrier (15); and wherein the support carrier 15*a* is furnished with bumpers (16) for a movable end of the oscillating crank (13); and wherein an extension of the oscillating crank (13) rests at an operating switch (17) disposed at the support carrier 15*a*.

12. The hoisting station for a rail-track section of a rail installation according to claim (11) wherein the pulling members (7, 19) are roller chains.

13. The hoisting station for a rail-track section of a rail installation according to claim 11 wherein the balancing weight (20) is adjustable in size.

14. The hoisting station for a rail-track section of a rail installation according to claim 11 wherein the balancing weight (20) is guided by rollers (21) at the two hoisting columns (1).

15. The hoisting station for a rail-track section of a rail installation according to claim 11 wherein the balancing-weight pulling member (19) is disposed between the pulling members (7) for the lifting and lowering of the hoisting carriage (2).

16. The hoisting station for a rail-track section of a rail installation according to claim 11 wherein the rocker (11) is preferably provided with a switching pilot 11*a* for a surveillance switch 28 attached to the hoisting carriage (2).

17. The hoisting station for a rail-track section of a rail installation according to claim 11 wherein the connection member (18) can be formed as a frame which is provided with an opening for accessing the surveillance switch (28).

18. The hoisting station for a rail-track section of a rail installation according to claim 11 wherein the motor (4), and the shaft (5) driven by the motor and employed for driving the drive wheels (6) of the pulling member (7), is disposed below the hoisting columns (1).

19. The hoisting station for a rail-track section of a rail installation according to claim 11 wherein the motor (4), and the shaft (5) driven by the motor for driving the drive wheels (6), is disposed at a distance from the hoisting carriage (2) on the side disposed opposite to the hoisting columns (1); and wherein the pulling members (7) are guided by the drive wheels (6) around deflection pulleys 6*a;* wherein the effective curve of the deflection pulleys 6*a* is disposed between the upper and the lower deflection pulleys (8).

20. The hoisting station for a rail-track section of a rail installation according to claim 11 wherein the pulling members (7, 19) are roller chains;

wherein the balancing weight (20) is adjustable in size;

wherein the balancing weight (20) is guided by rollers (21) at the two hoisting columns (1);

wherein the balancing-weight pulling member (19) is disposed between the pulling members (7) for the lifting and lowering of the hoisting carriage (2);

wherein the rocker (11) is provided with a switching pilot 11*a* for a surveillance switch (28) attached to the hoisting carriage (2);

wherein the connection member (18) is formed as a frame which is provided with an opening for accessing the surveillance switch (28);

wherein the motor (4), and the shaft (5) driven by the motor and employed for driving the drive wheels (6) of the pulling member (7), is disposed below the hoisting columns (1);

wherein the motor (4), and the shaft (5) driven by the motor for driving the drive wheels (6), disposed at a distance from the hoisting carriage (2) on the side disposed opposite to the hoisting columns (1); and wherein the pulling members (7) are preferably guided by the drive wheels (6) around deflection pulleys 6*a;* wherein the effective curve of the deflection pulleys 6*a* are preferably disposed between said upper and the lower deflection pulleys (8).

* * * * *